United States Patent [19]

Kobashi et al.

[11] 4,391,244

[45] Jul. 5, 1983

[54] DEVICE OF CONTROLLING THE IDLING SPEED OF AN ENGINE

[75] Inventors: Mamoru Kobashi, Aichi; Shinichiro Tanaka, Susono; Hideo Saji, Aichi, all of Japan

[73] Assignees: Toyota Jidosha Kogyo Kabushiki Kaisha, Toyota; Nippondenso Co., Ltd., Kariya, both of Japan

[21] Appl. No.: 387,755

[22] Filed: Jun. 11, 1982

[30] Foreign Application Priority Data

Jun. 22, 1981 [JP] Japan ..... 56-95213

[51] Int. Cl.[3] ..... F02D 11/10

[52] U.S. Cl. ..... 123/339

[58] Field of Search ..... 123/339, 340, 588

[56] References Cited

U.S. PATENT DOCUMENTS 3,960,130 6/1976 Peterson ..... 123/339

4,106,451 8/1978 Hahori ..... 123/588

4,186,697 2/1980 Vasuda ..... 123/339

*Primary Examiner*—Ronald B. Cox

*Attorney, Agent, or Firm*—Cushman, Darby & Cushman

[57] ABSTRACT

An engine comprising a main intake passage having a throttle valve therein. A bypass passage is branched off from the main intake passage located upstream of the throttle valve and is connected to the main intake passage located downstream of the throttle valve. A flow control valve, actuated by a step motor, is arranged in the bypass passage. When the engine is operating in an idling state, the step motor is rotated at a first speed in a rotating direction wherein the engine speed approaches a desired engine speed. When the ignition switch is turned to the OFF position for stopping the engine, the step motor is rotated at a second speed which is lower than the first speed a little while after the flow control valve fully opens the bypass passage.

10 Claims, 16 Drawing Figures

| Fig. 10A |
| --- |
| Fig. 10B |

DEVICE OF CONTROLLING THE IDLING SPEED OF AN ENGINE

BACKGROUND OF THE INVENTION

The present invention relates to a device of controlling the idling speed of an internal combustion engine.

An idling speed control device has been known in which a bypass passage is branched off from the intake passage of an engine, which is located upstream of a throttle valve, and connected again to the intake passage located downstream of the throttle valve, and a diaphragm type vacuum operated control valve device is arranged in the bypass passage. The diaphragm vacuum chamber of the control valve device is connected via a vacuum conduit to the intake passage located downstream of the throttle valve, and an electromagnetic control valve is arranged in the vacuum conduit for controlling the cross-sectional area of the vacuum conduit. In this idling speed control device, at the time of idling, the level of the vacuum produced in the diaphragm vacuum chamber of the control valve device is controlled by controlling the electromagnetic control valve in accordance with the operating condition of the engine and, in addition, the air flow area of the bypass passage is controlled in accordance with a change in the level of the vacuum produced in the diaphragm vacuum chamber. As a result of this, the amount of air fed into the cylinders of the engine from the bypass passage is controlled. However, in such a conventional idling speed control device, firstly, in the case wherein a vehicle is used in a cold region, the electromagnetic control valve becomes frozen and, thus, it is impossible to control the cross-sectional area of the vacuum conduit. As a result of this, since it is also impossible to control air flow area of the bypass passage, a problem occurs in that it is impossible to control the amount of air fed into the cylinders from the bypass passage. Secondly, in a conventional idling speed control device, since the diaphragm type vacuum operated control valve device is used, the controllable range of the air flow area of the bypass passage is very narrow. Therefore, even if the control valve device is fully opened, air, the amount of which is necessary to operate the engine at the time of fast idling, cannot be fed into the cylinders of the engine from the bypass passage. Consequently, in a conventional idling speed control device, an additional bypass passage is provided in addition to the regular bypass passage, and a valve, which is actuated by a bimetallic element, is arranged in the additional bypass passage. When the temperature of the engine is low, the valve, which is actuated by the bimetallic element, opens. As a result of this, since additional air is fed into the cylinders of the engine from the additional bypass passage in addition to the air fed into the cylinders of the engine from the regular bypass passage, the amount of air, which is necessary to operate the engine at the time of fast idling, can be ensured. As mentioned above, in a conventional idling speed control device, since the additional bypass passage and the valve, actuated by the bimetallic element, are necessary in addition to the regular bypass passage, a problem occurs in that the construction of the idling speed control device will be complicated. In addition, since the amount of air fed into the cylinders of the engine is controlled by only the expanding and shrinking action of the bimetallic element at the time of fast idling, there is a problem in that it is impossible to precisely control the amount of air fed into the cylinders of the engine.

SUMMARY OF THE INVENTION

An object of the present invention is to provide a novel device of controlling the idling speed, which device is capable of precisely controlling the amount of air flowing within the bypass passage at the time of idling and maintaining the idling speed of the engine at an optimum speed.

According to the present invention, there is provided a device of controlling the idling speed of an engine comprising a main intake passage, a throttle valve arranged in the main intake passage, a bypass passage branched off from the main intake passage upstream of the throttle valve and connected to the main intake passage downstream of the throttle valve, and a control valve arranged in the bypass passage, said device comprising: a step motor actuating the control valve for controlling the amount of air flowing within the bypass passage; first means for detecting the engine speed to produce an output signal indicating the engine speed, second means for detecting the operating condition of the engine to produce an output signal indicating that the engine is operating in an idling state, electronic control means operated in response to the output signal of said first means and the output signal of said second means and producing continuous control pulse signals at predetermined first time intervals for rotating the step motor in a stepping manner at a first speed in a rotating direction wherein the engine speed approaches a desired engine speed when the engine is operating in an idling state, and; power supply control means including an ignition switch and inserted between said electronic control means and a power source, said electronic control means producing continuous control pulse signals at predetermined second time intervals which are longer than said first time intervals for rotating the step motor in a predetermined rotating direction at a second speed which is lower than said first speed when the ignition switch is turned to the OFF position.

The present invention may be more fully understood from the description of a preferred embodiment of the invention set forth below, together with the accompanying drawings.

DESCRIPTION OF A PREFERRED EMBODIMENT

Figure 1:
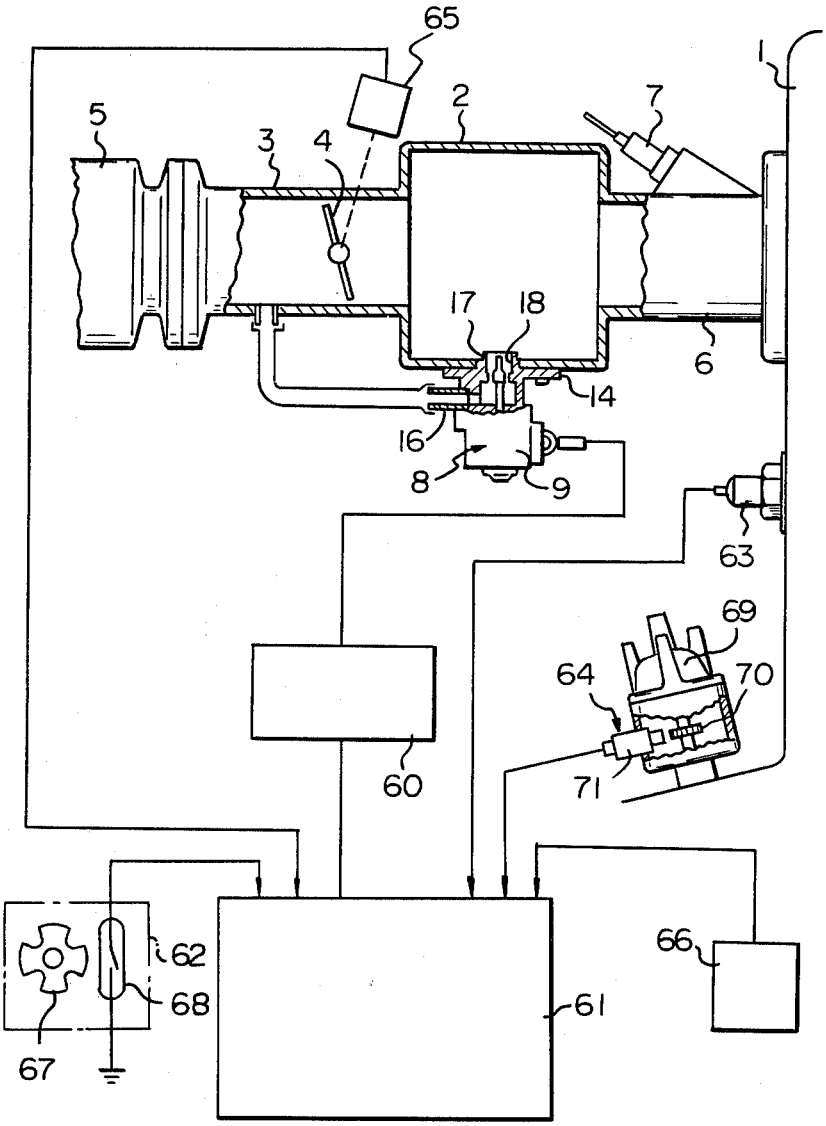
FIG. 1 is a side view, partly in cross-section, of an intake system equipped with an idling speed control device according to the present invention.
Figure 2:
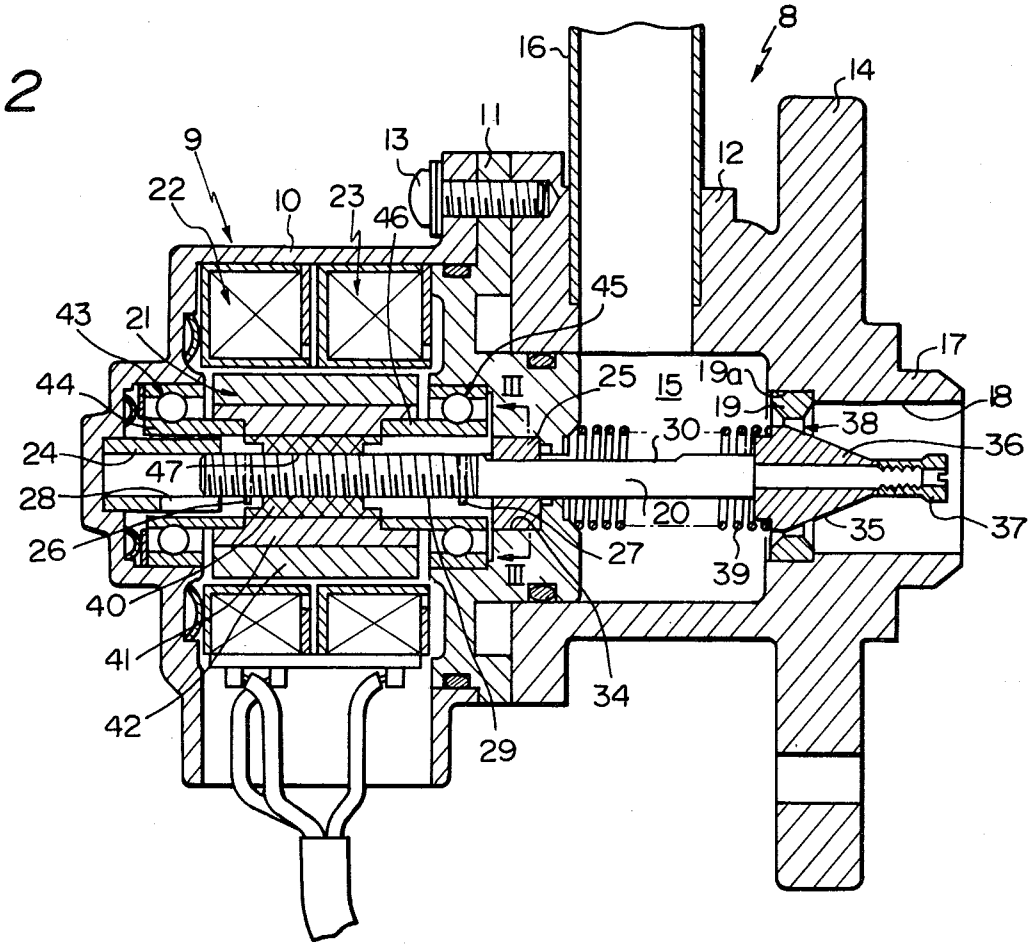
FIG. 2 is a cross-sectional side view of a flow control valve device.

Referring to FIG. 1, 1 designates an engine body, 2 a surge tank, 3 an intake duct, 4 a throttle valve and 5 an air flow meter. The inside of the intake duct 3 is connected to the atmosphere via the air flow meter 5 and an air chamber (not shown). The surge tank 2, which is common to all the cylinders of the engine, has a plurality of branch pipes 6, each being connected to the corresponding cylinder of the engine. A fuel injector 7 is provided for each cylinder and mounted on the corresponding branch pipe 6. In addition, a flow control valve device 8 is mounted on the surge tank 2. As illustrated in FIG. 2, the flow control valve device 8 comprises a motor housing 10 of a step motor 9, a motor housing end plate 11 and a valve housing 12. The motor housing 10, and end plate 11 and the valve housing 12 are interconnected to each other by means of bolts 13. As illustrated in FIGS. 1 and 2, a flange 14 is formed in one piece on the valve housing 12 and fixed onto the outer wall of the surge tank 2. A valve chamber 15 is formed in the valve housing 12 and connected via a bypass pipe 16, fixed onto the valve housing 12, to the inside of the intake duct 3, which is located upstream of the throttle valve 4. In addition, a hollow cylindrical projection 17, projecting into the surge tank 2, is formed in one piece on the side wall of the flange 14, and a cylindrical air outflow bore 18 is formed in the hollow cylindrical projection 17. An annular groove 19*a* is formed on the inner end of the air outflow bore 18, and a valve seat 19 is fitted into the annular groove 19*a*.

Figure 3:
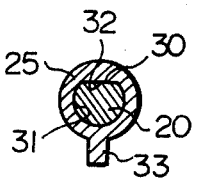
FIG. 3 is a cross-sectional view taken along the line III—III in FIG. 2.
Figure 4:
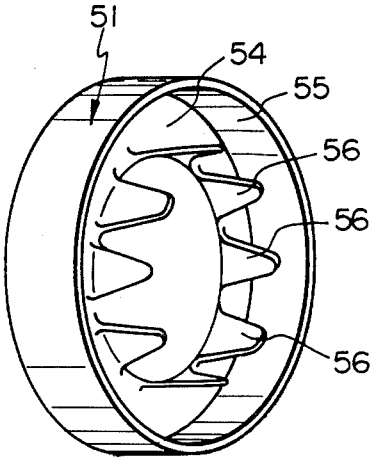
FIG. 4 is a perspective view of a stator core member.
Figure 5:
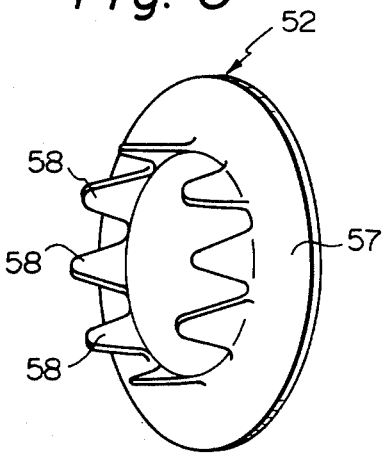
FIG. 5 is a perspective view of a stator core member.

As illustrated in FIG. 2, the step motor 9 comprises a valve shaft 20, a rotor 21 coaxially arranged with the valve shaft 20, and a pair of stators 22, 23, each being stationarily arranged in the motor housing 10 and spaced from the cylindrical outer wall of the rotor 21 by a slight distance. The end portion of the valve shaft 20 is supported by a hollow cylindrical bearing 24 made of a sintered metal and fixed onto the motor housing 10, and the intermediate portion of the valve shaft 20 is supported by a hollow cylindrical bearing 25 made of a sintered metal and fixed onto the end plate 11. A first stop pin 26, which abuts against the rotor 21 when the valve shaft 20 reaches the most advanced position, is fixed onto the valve shaft 20, and a second stop pin 27, which abuts against the rotor 21 when the valve shaft 20 reaches the most retracting position, is fixed onto the valve shaft 20. In addition, an axially extending slot 28, into which the first stop pin 26 is able to enter, is formed in the bearing 14. External screw threads 29 are formed on the outer circumferential wall of the valve shaft 20, which is located within the motor housing 10. The external screw threads 29 extend towards the right in FIG. 2 from the left end of the valve shaft 20 and terminate at a position wherein the valve shaft 20 passes through the second stop pin 27 by a slight distance. In addition, an axially extending flat portion 30, which extends towards the right in FIG. 2 from a position near the terminating position of the external screw threads 29, is formed on the outer circumferential wall of the valve shaft 20. As illustrated in FIG. 3, the inner wall of the shaft bearing hole of the bearing 25 comprises a cylindrical wall portion 31 and a flat wall portion 32 which have a complementary shape relative to the outer circumferential wall of the valve shaft 20. Consequently, the valve shaft 20 is supported by the bearing 25 so that the valve shaft 20 cannot be rotated, but is able to slide in the axial direction. In addition, as illustrated in FIG. 3, an outwardly projecting arm 33 is formed in one piece on the outer circumferential wall of the bearing 25, and a bearing receiving hole 34 (FIG. 2), having a contour shape which is the same as that of the bearing 25, is formed on the inner wall of the end plate 11. Consequently, when the bearing 25 is fitted into the bearing receiving hole 34, as illustrated in FIG. 2, the bearing 25 is non-rotatably supported by the end plate 11. A valve head 36, having a substantially conical shaped outer wall 35, is secured onto the tip of the valve shaft 20 by means of a nut 37, and an annular air flow passage 38 is formed between the valve seat 19 and the conical outer wall 35 of the valve head 36. In addition, a compression spring 39 is inserted between the valve head 36 and the end plate 11 in the valve chamber 15.

As illustrated in FIG. 2, the rotor 21 comprises a hollow cylindrical inner body 40 made of a synthetic resin, a hollow cylindrical intermediate body 41 made of a metallic material and rigidly fitted onto the outer circumferential wall of the hollow cylindrical inner body 40, and a hollow cylindrical outer body 42 made of a permanent magnet and fixed onto the outer circumferential wall of the hollow cylindrical intermediate body 41 by using an adhesive. As will be hereinafter described, an N pole and S pole are alternately formed on the outer circumferential wall of the hollow cylindrical outer body 42 made of a permanent magnet along the circumferential direction of the outer circumferential wall of the hollow cylindrical outer body 42. As illustrated in FIG. 2, one end of the hollow cylindrical intermediate body 41 is supported by the inner race 44 of a ball bearing 43 which is supported by the motor housing 10, and the other end of the hollow cylindrical intermediate body 41 is supported by the inner race 46 of a ball bearing 45 which is supported by the end plate 11. Consequently, the rotor 21 is rotatably supported by a pair of the ball bearings 43 and 45. Internal screw threads 47, which are in engagement with the external screw threads 29 of the valve shaft 20, are formed on the inner wall of the central bore of the hollow cylindrical inner body 40. Therefore, when the rotor 21 rotates, the valve shaft 20 is caused to move in the axial direction.

Figure 7:
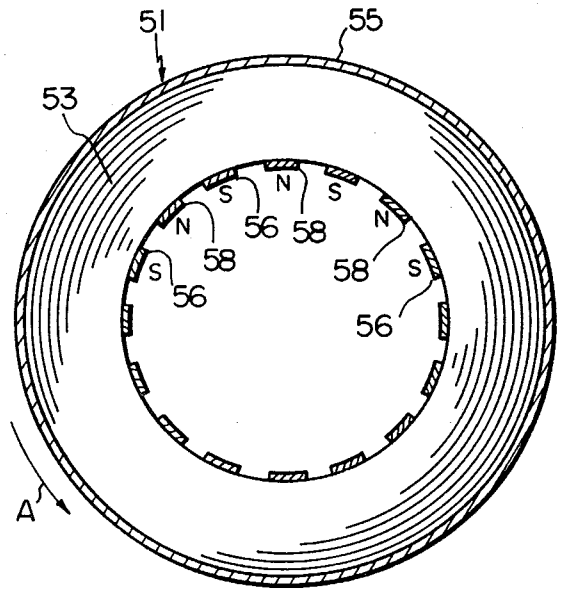
FIG. 7 is a cross-sectional view taken along the line VII—VII in FIG. 6.
Figure 6:
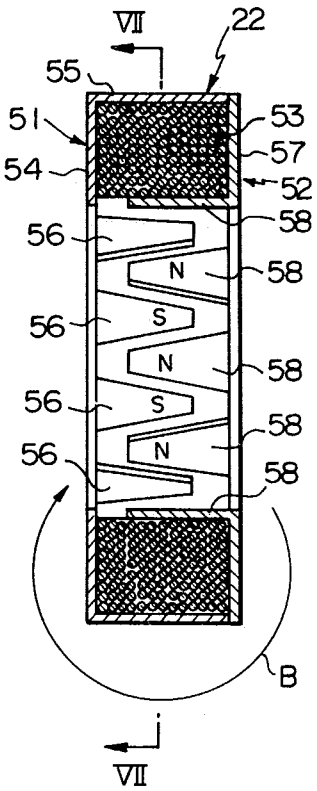
FIG. 6 is a cross-sectional side view of a stator.

The stators 22 and 23, which are stationarily arranged in the motor housing 10, have the same construction and, therefore, the construction of only the stator 22 will be hereinafter described with reference to FIGS. 4 through 7. Referring to FIGS. 4 through 7, the stator 22 comprises a pair of stator core members 51 and 52, and a stator coil 53. The stator core member 51 comprises an annular side wall portion 54, an outer cylindrical portion 55, and eight pole pieces 56 extending perpendicular to the annular side wall portion 54 from the inner periphery of the annular side wall portion 54. The pole pieces 56 have a substantially triangular shape, and each of the pole pieces 56 is spaced from the adjacent pole piece 56 by the same angular distance. On the other hand, the stator core member 52 comprises an annular side wall portion 57 and eight pole pieces 58 extending perpendicular to the annular side wall portion 57 from the inner periphery of the annular side wall portion 57. The pole pieces 58 have a substantially triangular shape, and each of the pole pieces 58 is spaced from the adjacent pole piece 58 by the same angular distance. The stator core members 51 and 52 are assembled so that each of the pole pieces 56 is spaced from the adjacent pole piece 58 by the same angular distance as illustrated in FIGS. 6 and 7. When the stator core members 51 and 52 are assembled, the stator core members 51 and 52 construct a stator core. When an electric current is fed into the stator coil 53 and flows within the stator coil 53 in the direction illustrated by the arrow A in FIG. 7, a magnetic field, the direction of which is as illustrated by the arrow B in FIG. 6, generates around the stator coil 53. As a result of this, the S poles are produced in the pole pieces 56 and, at the same time, the N poles are produced in the pole pieces 58. Consequently, it will be understood that an N pole and an S pole are alternately formed on the inner circumferential wall of the stator 22. On the other hand, if an electric current flows within the stator coil 22 in the direction which is opposite to that illustrated by the arrow A in FIG. 7, the N poles are produced in the pole pieces 56 and, at the same time, the S poles are produced in the pole pieces 58.

Figure 8:
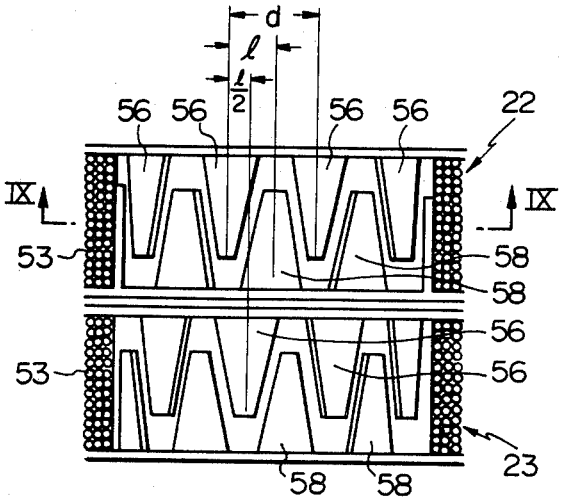
FIG. 8 is a cross-sectional plan view of the stator illustrated in FIG. 2.
Figure 9:
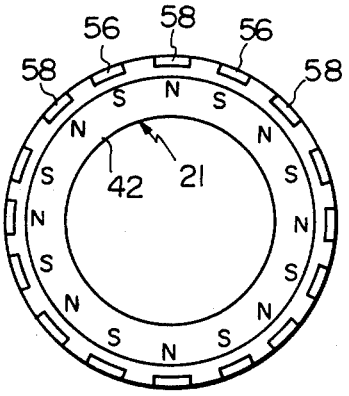
FIG. 9 is a schematic cross-sectional side view taken along the line IX—IX in FIG. 8.

FIG. 8 illustrates the case wherein the stators 22 and the stator 23 are arranged in tandem as illustrated in FIG. 2. In FIG. 8, similar components of the stator 23 are indicated with the same reference numerals used in the stator 22. As illustrated in FIG. 8, assuming that the distance between the pole piece 56 of the stator 22 and the adjacent pole piece 58 of the stator 22 is indicated by l, each of the pole pieces 56 of the stator 23 is offset by l/2 from the pole piece 56 of the stator 22, which is arranged nearest to the pole piece 56 of the stator 23. That is, assuming that the distance d between the adjacent pole pieces 56 of the stator 23 is one pitch, each of the pole pieces 56 of the stator 23 is offset by a ¼ pitch from the pole piece 56 of the stator 22, which is arranged nearest to the pole piece 56 of the stator 23. On the other hand, as illustrated in FIG. 9, the N pole and the S pole are alternately formed on the outer circumferential wall of the hollow cylindrical outer body 42 of the rotor 21 along the circumferential direction of the outer circumferential wall of the hollow cylindrical outer body 42, and the distance between the N pole and the S pole, which are arranged adjacent to each other, is equal to the distance between the pole piece 56 and the pole piece 58 of the stator 22 or 23, which are arranged adjacent to each other.

Turning to FIG. 1, the step motor 9 is connected to an electric control unit 61 via a step motor drive circuit 60. In addition, a vehicle speed sensor 62, a cooling water temperature sensor 63, an engine speed sensor 64, a throttle switch 65, and a neutral switch 66 of the automatic transmission (not shown) are connected to the electronic control unit 61. The vehicle speed sensor 62 comprises, for example, a rotary permanent magnet 67 arranged in the speed meter (not shown) and rotated by the speed meter cable (not shown), and a reed switch 68 actuated by the rotary permanent magnet 67. A pulse signal, having a frequency which is proportional to the vehicle speed, is input into the electronic control unit 61 from the vehicle speed sensor 62. The cooling water temperature sensor 63 is provided for detecting the cooling water of the engine, and a signal, representing the temperature of the cooling water, is input into the electronic control unit 61 from the cooling water temperature sensor 63. The engine speed sensor 64 comprises a rotor 70 rotating in a distributor 69 in synchronization with the rotation of the crank shaft (not shown), and an electromagnetic pick-up 71 arranged to face the saw tooth shaped outer periphery of the rotor 70. A pulse is input into the electronic control unit 61 from the engine speed sensor 64 everytime the crank shaft rotates at a predetermined angle. The throttle switch 65 is operated by the rotating motion of the throttle valve and turned to the ON position when the throttle valve 4 is fully closed. The operation signal of the throttle switch 65 is input into the electronic control unit 61. The neutral switch 66 is provided for detecting whether the automatic transmission is in the drive range D or in the neutral range N, and the detecting signal of the neutral switch 66 is input into the electronic control unit 61.

Figures 10, 10A:
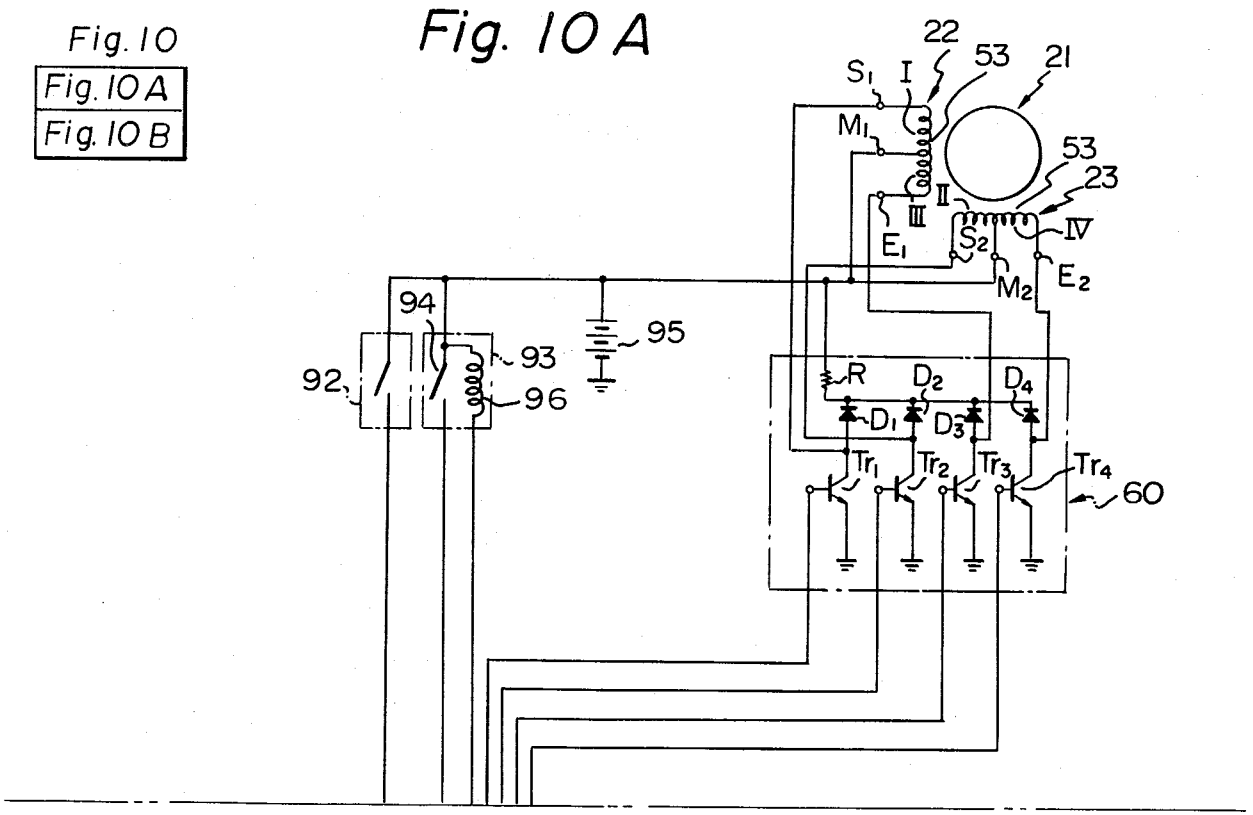
FIGS. 10A and 10B are a circuit of an electronic control unit.
Figure 10B:
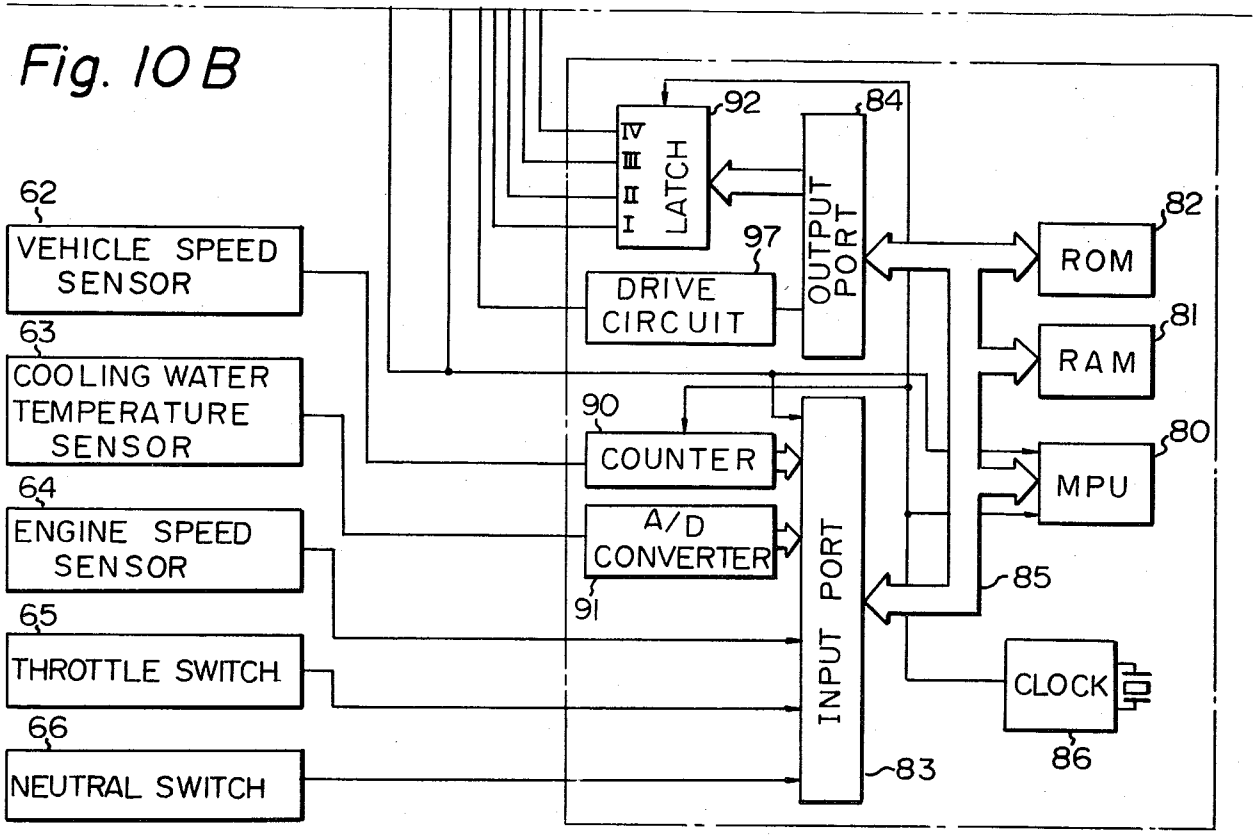

FIG. 10 illustrates the step motor drive circuit 60 and the electronic control unit 61. Referring to FIG. 10, the electronic control unit 61 is constructed as a digital computer and comprises a microprocessor (MPU) 80 executing the arithmetic and logic processing, a random-access memory (RAM) 81, a read-only memory (ROM) 82 storing a predetermined control program and an arithmetic constant therein, an input port 83 and an output port 84 are interconnected to each other via a bidirectional bus 85. In addition, the electronic control unit 61 comprises a clock generator 86 generating various clock signals. Furthermore, the electronic control unit 61 comprises a counter 90, and the vehicle speed sensor 62 is connected to the input port 83 via the counter 90. The number of output pulses, issued from the vehicle speed sensor 62, is counted for a fixed time period in the counter 87 by the clock signal of the clock generator 86, and the binary coded count value, which is proportional to the vehicle speed, is input into the MPU 80 via the input port 83 and the bus 85 from the counter 90. In addition, the electronic control unit 61 comprises an A-D converter 91, and the cooling water temperature sensor 63 is connected to the input port 83 via the A-D converter 91. The cooling water temperature sensor 63 comprises, for example, a thermistor element and produces output voltage which is proportional to the temperature of the cooling water of the engine. The output voltage of the cooling water temperature sensor 63 is converted to the corresponding binary code in the A-D converter 91, and the binary code is input into the MPU 80 via the input port 83 and the bus 85. The output signals of the engine speed sensor 64, the throttle switch 65 and the neutral switch 66 are input into the MPU 80 via the input port 83 and the bus 85. In the MPU 80, the time interval of the output pulses issuing from the engine speed sensor 64 is calculated, and the engine speed is calculated from the time interval. On the other hand, the output terminals of the output port 84 are connected to the corresponding input terminals of the latch 92, and the output terminals of the latch 92 are connected to the step motor drive circuit 60. Step motor drive data, obtained in the MPU 80, is written in the output port 84, and the step motor drive data is retained in the latch 92 for a fixed time period of the clock signal of the clock generator 86. The power source terminal of the electronic control unit 61 is connected to a power source 95 via an ignition switch 92 and the switch 94 of a main relay 93, which are arranged in parallel. The switch 94 is actuated by the coil 96 of the main relay 93. One of the ends of the coil 96 is connected to the power source 95, and the other end of the coil 96 is connected to the output port 84 via a drive circuit 97. The coil 96 of the main relay 93 is energized when the ignition switch 92 is turned to the ON position. In addition, the opening and closing operation of the ignition switch 92 is input into the MPU 80 via the input port 83 and the bus 85.

On the other hand, in FIG. 8, the stator coil 53 of the stator 22 is wound in the direction which is the same as the winding direction of the stator coil 53 of the stator 23. In FIG. 10, the winding start terminals of the stator coils 53 of the stators 22 and 23 are indicated by $S_1$ and $S_2$, respectively, and the winding end terminals of the stator coils 53 of the stators 22 and 23 are indicated by $E_1$ and $E_2$, respectively. In addition, in FIG. 10, the intermediate taps of the stator coils 53 of the stators 22 and 23 are indicated by $M_1$ and $M_2$, respectively. In the stator 22, the stator coil 53, located between the winding start terminal $S_1$ and the intermediate tap $M_1$, constructs a first phase exciting coil I, and the stator coil 53, located between the winding end terminal $E_1$ and the intermediate tap $M_1$, constructs a second phase exciting coil II. In addition, in the stator 23 the stator coil 53, located between the winding start terminals $S_2$ and the intermediate terminal $M_2$, constructs a third phase exciting coil III, and the stator coil 53, located between the winding end terminal $E_2$ and the intermediate tap $M_2$, constructs a fourth phase exciting coil IV. As illustrated in FIG. 10, the drive control circuit 60 comprises four transistors $Tr_1$, $Tr_2$, $Tr_3$ and $Tr_4$, and the winding start terminals $S_1$ and $S_2$ and the winding end terminals $E_1$ and $E_2$ are connected to the collectors of the transistor $Tr_1$, $Tr_2$, $Tr_3$ and $Tr_4$, respectively. In addition, the intermediate taps $M_1$ and $M_2$ are grounded via the power source 89. The collectors of the transistor $Tr_1$, $Tr_2$, $tr_3$ and $Tr_4$ are connected to the power source 89 via corresponding diodes $D_1$, $D_2$, $D_3$ and $D_4$ for absorbing a surge current and via a resistor R, and the emitters of the transistor $Tr_1$, $Tr_2$, $Tr_3$ and $Tr_4$ are grounded. In addition, the bases of the transistors $Tr_1$, $Tr_2$, $Tr_3$ and $Tr_4$ are connected to the corresponding output terminals of the latch 92.

Figure 11:
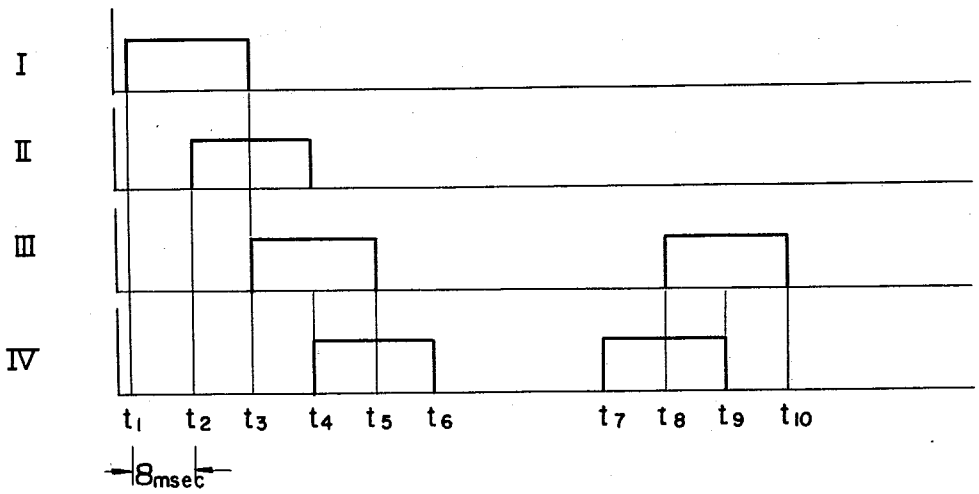
FIG. 11 is a time chart of control pulses of a step motor.

As mentioned above, in the MPU 80, the engine speed is calculated on the basis of the output pulses of the engine speed sensor 64. On the other hand, a function, representing a desired relationship between, for example, the temperature of the cooling water of the engine and the engine idling speed, and a function, representing a desired relationship between the range of the automatic transmission and the engine idling speed, are stored in the ROM 82 in the form of a formula or a data table. In the MPU 80, the rotating direction of the step motor 9, which is necessary to equalize the engine speed to a predetermined engine idling speed, is determined from the above-mentioned function and the engine speed at which the engine is now driven and, in addition, a step motor drive data, which is necessary to rotate the step motor 9 in a stepping manner in the above-mentioned rotating direction, is obtained. Then, the step motor drive data is written in the output port 84. This writing operation of the step motor drive data is executed, for example, every 8 msec, and the step motor drive data, written in the output port 84, is retained in the latch 92 for 8 msec. For example, four bits drive data "1000" is input to the output port 84 from the MPU 80 and, if the output terminals of the latch 92, which are connected to the transistors $Tr_1$, $Tr_2$, $Tr_3$ and $Tr_4$, are indicated by I, II, III and IV, respectively, the output signals "1", "0", "0" and "0" are produced at the output terminals I, II, III and IV of the latch 92, respectively, for 8 msec. FIG. 11 illustrates output signals produced at the output terminals I, II, III, IV of the latch 92. From FIG. 11, it will be understood that, during the time period from the time $t_1$ to the time $t_2$, the output signals "1", "0", "0" and "0" are produced at the output terminals I, II, III and IV of the latch 92, respectively. When the output signal, produced at the output terminal I of the latch 92, becomes "1", since the transistor $Tr_1$ is turned to the ON condition, the first phase exciting coil I is excited. Then, at the time $t_2$ in FIG. 11, if it is determined in the MPU 80 that the step motor 9 should be moved by one step in the direction wherein the valve body 36 (FIG. 2) opens, the step motor drive data "1100" is written in the output port 84. As a result of this, as illustrated in FIG. 11, during the time period from the time $t_2$ to the time $t_3$, the output signals "1", "1", "0" and "0" are produced at the output terminals I, II, III and IV of the latch 92, respectively. Consequently, at this time, the transistor $Tr_2$ is also turned to the ON condition and, thus, the second phase exciting coil II is excited. As in the same manner as described above, during the time period from the time $t_3$ to the time $t_4$ in FIG. 11, since the output signals "0", "1", "1" and "0" are produced at the output terminals I, II, III and IV of the latch 92, respectively, the second phase exciting coil II and the third phase exciting coil III are excited and, during the time period from the time $t_4$ to the time $t_5$ in FIG. 11, since the output signals "0", "0", "1" and "1" are produced at the output terminals I, II, III and IV of the latch 92, respectively, the third phase exciting coil III and the fourth phase exciting coil IV are excited. From FIG. 11, it will be understood that the time duration necessary for the production of the output signals produced at the output terminals I, II, III, IV of the latch 92, that is, the length of time necessary to produce the exciting pulses applied to the exciting coils I, II, III, IV is the same, and that the each length of time necessary to produce the exciting pulses applied to the adjacent two phase exciting coils overlaps by one half as is shown in FIG. 11. An exciting system, in which the time periods of production of the exciting pulses applied to the adjacent two phase exciting coils are overlapped by one half, is called a two-phase exciting system.

Figure 12:
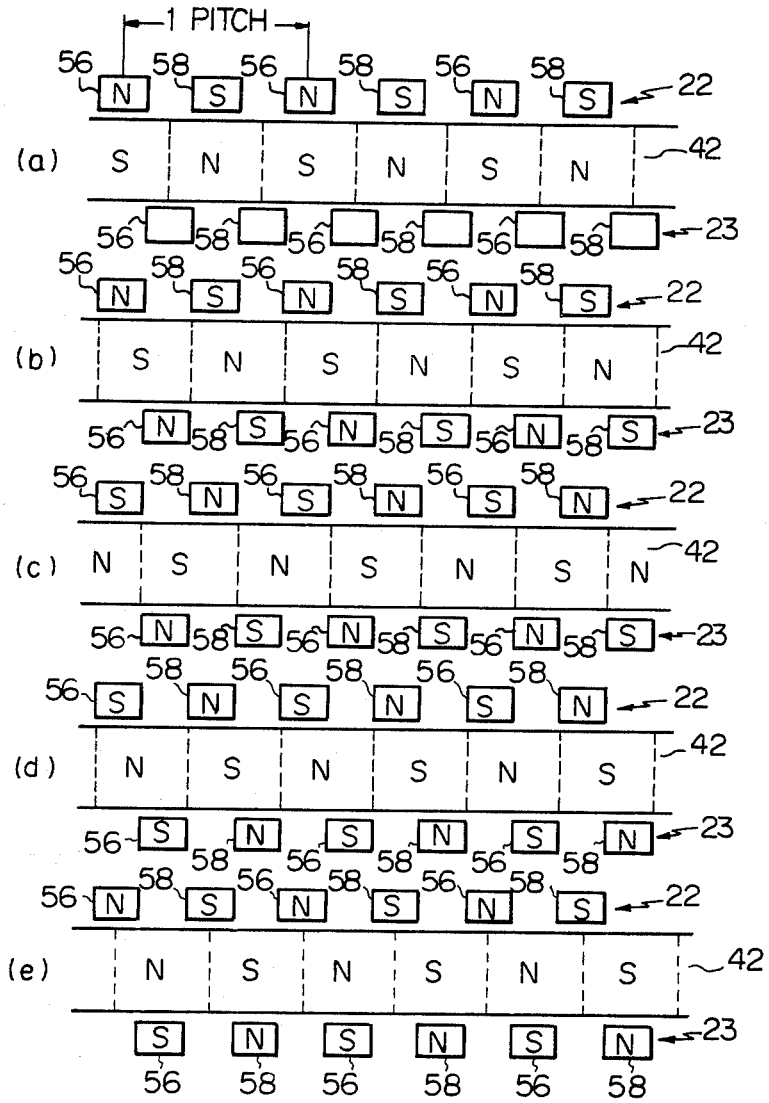
FIG. 12 is a schematically illustrative view of the stator and the rotor of a step motor.

FIG. 12 illustrates a schematic developed view of the outer circumferential surface of the hollow cylindrical outer body 42 of the rotor 21 and the pole pieces 56, 58 of the stators 22, 23. FIG. 12 (*a*) illustrates the case wherein only the first phase exciting coil I is excited as illustrated in FIG. 11 between the time $t_1$ and the time $t_2$. At this time, the polarity of the pole pieces 56 of the stator 22 is N, and the polarity of the pole pieces 58 of the stator 22 is S. Contrary to this, the polarity does not appear on the pole pieces 56, 58 of the stator 23. Consequently, at this time, the rotor 21 remains stopped at a position wherein each of the pole pieces 56 of the stator 22 faces the corresponding S pole of the hollow cylindrical outer body 42, and each of the pole pieces 58 of the stator 22 faces the corresponding N pole of the hollow cylindrical outer body 42. When the second phase exciting coil II is excited, as illustrated between the time $t_2$ and the time $t_3$ in FIG. 11, since the flow direction of the current in the secondary phase exciting coil II is the same as that of the current in the first phase exciting coil I, the polarity of the pole pieces 56 of the stator 23 becomes N, and the polarity of the pole pieces 58 of the stator 23 becomes S, as illustrated in FIG. 12 (*b*). Consequently, at this time, the hollow cylindrical outer body 42 moves to a position wherein each of the S poles of the hollow cylindrical outer body 42 is located between the corresponding pole pieces 56 of the stator 22 and the corresponding pole pieces 56 of the stator 23, and each of the N poles of the hollow cylindrical outer body 42 is located between the corresponding pole pieces 58 of the stator 22 and the corresponding pole pieces 58 of the stator 23. Therefore, assuming that the distance between the adjacent two pole pieces 56 of the stator 22 is one pitch, as mentioned previously, the hollow cylindrical outer body 42 moves by a $\frac{1}{8}$ pitch towards the right in FIG. 12 from a position illustrated in FIG. 12 (*a*) to a position illustrated in FIG. 12 (*b*).

After this, when the third phase exciting coil III is excited, as illustrated between the time $t_3$ and the time $t_4$ in FIG. 11, since the flow direction of the current in the third phase exciting coil III is opposite to that of the current in the first phase exciting coil I, the polarity of the pole pieces 56 of the stator 22 becomes S, and the polarity of the pole pieces 58 of the stator 22 becomes N as illustrated in FIG. 12 (*c*). As a result of this, the hollow cylindrical outer body 42 moves by a $\frac{1}{4}$ pitch towards the right in FIG. 12 from a position illustrated in FIG. 12 (*b*) to a position illustrated in FIG. 12 (*c*). In the same manner as described above, when the fourth phase exciting coil IV is excited, as illustrated between the time $t_4$ and the time $t_5$ in FIG. 11, the hollow cylindrical outer body 42 moves by a $\frac{1}{4}$ pitch towards the right in FIG. 12 from a position illustrated in FIG. 12 (*c*) to a position illustrated in FIG. 12 (*d*). After this, during the time period from the time $t_5$ to the time $t_6$, only the fourth phase exciting coil IV is excited and, thus, the polarity does not appear on the pole pieces 56, 58 of the stator 22 as illustrated in FIG. 12 (*e*). Consequently, at this time, the hollow cylindrical outer body 42 moves by a $\frac{1}{8}$ pitch towards the right in FIG. 12 from a position illustrated in FIG. 12 (*d*) to a position illustrated in FIG. 12 (*e*), so that each of the pole pieces 56 of the stator 23 faces the corresponding N pole of the hollow cylindrical outer body 42, and each of the pole pieces 58 of the stator 23 faces the corresponding S pole of the hollow cylindrical body 42. Then, at the time $t_6$ in FIG. 11, the step motor drive data "0000" is written in the output port 84 and, thus, since all the output signals, produced at the output terminals I, II, III, IV of the latch 92, become "0", the exciting operation of all the exciting coils I, II, III, IV is stopped. At this time, as illustrated in FIG. 12 (*e*), each of the pole pieces 56 of the stator 23 faces the corresponding N pole of the hollow cylindrical outer body 42, and each of the pole pieces 58 of the stator 23 faces the corresponding S pole of the hollow cylindrical outer body 42. Consequently, the hollow cylindrical outer body 42 is stationarily retained at a position illustrated in FIG. 12 (*e*) due to the attracting forces of the N pole and the S pole of the hollow cylindrical outer body 42, which forces act on the pole pieces 56 and the pole pieces 58 of the stator 23, respectively. In addition, an exciting data, indicating that the fourth phase exciting coil IV is excited before the hollow cylindrical outer body 42 is stationarily retained as mentioned above, is stored in a predetermined address in the RAM 81.

At the time $t_7$ in FIG. 11, in the case wherein, it is determined in the MPU 80 that the step motor 9 should be moved by one step in the direction wherein the valve body 36 (FIG. 2) opens, an exciting data, indicating the phase of the exciting coil which was finally excited, it read out from the RAM 81 and, if the phase of the exciting coil which was finally excited is the fourth phase, the step motor drive data "0001" is initially written in the output port 84. Consequently, only the fourth phase exciting coil IV is excited as illustrated between the time $t_7$ and the time $t_8$ in FIG. 11. At this time, since the hollow cylindrical outer body 42 is located in a position illustrated in FIG. 12 (*e*), the hollow cylindrical outer body 42 remains stationary. After this, when the third phase exciting coil III is excited as illustrated, between the time $t_8$ and the time $t_9$, the polarities, as illustrated in FIG. 12 (*d*) appear on the pole pieces 56, 58 of the stators 22, 23 and, thus, the hollow cylindrical outer body 42 moves by a $\frac{1}{8}$ towards the left in FIG. 12 from a position illustrated in FIG. 12 (*e*) to a position illustrated in FIG. 12 (*d*).

As illustrated between the time $t_1$ and the time $t_6$ in FIG. 11, when the exciting coils I, II, III, IV are successively excited from the first phase exciting coil I to the fourth phase exciting coil IV, the hollow cylindrical outer body 42 of the rotor 21 moves relative to the stators 22, 23 and, accordingly, the rotor 21 rotates in one direction. When the rotor 21 rotates, since the external screw threads 29 of the valve shaft 20 is in engagement with the internal screw threads 47 of the hollow cylindrical inner body 40, as illustrated in FIG. 2, the valve shaft 20 is caused to move in one direction, for example, towards the left in FIG. 2. As a result of this, since the cross-sectional area of the annular air flow passage 38 formed between the valve head 36 and the valve seat 19 is increased, in FIG. 1, the amount of air fed via the bypass pipe 16 into the surge tank 2 from the intake duct 3 located upstream of the throttle valve 4 is increased. Contrary to this, during the time period between the time $t_7$ and the time $t_{10}$, since the valve shaft 20 is caused to move towards the right in FIG. 2, the cross-sectional area of the annular air flow passage 38 formed between the valve head 36 and the valve seat 19 is reduced.

The entire step number of the step motor 9 illustrated in FIG. 2 is equal to 125. In the present invention, when the engine is operating, since the step motor 9 is so controlled that the step position of the step motor 9 becomes equal to a predetermined step position, the present step position of the step motor 9 is always monitored by the MPU 80 and, at the same time, stored in a predetermined address of the RAM 81. In the embodiment illustrated in FIG. 1, since the present step position of the step motor 9 is calculated on the basis of the distance from a reference step start position wherein the valve head 36 (FIG. 2) is fully opened, it is necessary to return the valve head 36 to the fully opened position before the engine is started. To this end, in the present invention, where the ignition switch 92 is turned to the OFF position, the step motor 9 is rotated until the valve head 36 is fully opened. As mentioned above, when the engine is operating in an idling state, the engine speed is controlled in such a way that the step motor 9 is rotated by the control pulse signal which is produced every 8 msec as illustrated in FIG. 11. However, when the ignition switch 92 is turned to the OFF position, if the step motor 9 is rotated by the control pulse signal which is produced every 8 msec for returning the valve head 36 to the fully opened position, since the rotating speed of the rotor 21 is very high, the hollow cylindrical inner body 40 of the rotor 21 comes into engagement with the second stop pin 27 at a high speed when the valve head 36 is fully opened. As a result of this, after the hollow cylindrical inner body 40 comes into engagement with the second step pin 27, the rotor 21 is reversely rotated due to the reaction force produced when the hollow cylindrical inner body 40 comes into engagement with the second stop pin 27 and, thus, a problem occurs in that it is impossible to stop the step motor 9 at a position wherein the valve head 36 is fully opened. For example, assuming that the hollow cylindrical inner body 40 of the rotor 42 comes into engagement with the second stop pin 27 in the state illustrated in FIG. 12 (*b*), the polarities of the pole pieces 56, 58 are changed as illustrated in FIG. 12 (*c*) after 8 msec has elapsed. At this time, since the hollow cylindrical inner body 40 is in a unstable state, the hollow cylindrical inner body 40 moves by a $\frac{3}{4}$ pitch towards the left in FIG. 12 due to the above-mentioned reaction force and reaches a stable position as illustrated in FIG. 12 (*c*). After this, when 8 msec has elapsed, the hollow cylindrical inner body 40 further moves by a $\frac{3}{4}$ pitch towards the left in FIG. 12 and reaches a stable position as illustrated in FIG. 12 (*d*). As mentioned above, in the case wherein the rotating speed of the step motor 9 is very high and, thus, the above-mentioned reaction force is great, since the step motor 9 is reversely rotated, it is impossible to stop the step motor 9 at a position wherein the valve head 36 (FIG. 2) is fully opened. If the rotating speed of the step motor 9 is reduced, it is possible to stop the step motor 9 at a position wherein the valve head 36 is fully opened. However, such a reduction of the rotating speed of the step motor 9 causes a reduction in the responsiveness of the engine speed control in an idling state. In the present invention, when the ignition switch 92 is turned to the OFF position, the step motor 9 is slowly rotated in a rotating direction wherein the valve head 36 is fully opened by increasing the duration of production of the control pulse signal. As a result of this, since the hollow cylindrical inner body 40 is retained in a stable state a little while after the hollow cylindrical inner body 40 comes into engagement with the second stop pin 27, and since the above-mentioned reaction force is reduced, it is possible to stop the step motor 9 at a position wherein the valve head 36 is fully opened.

Figure 13A:
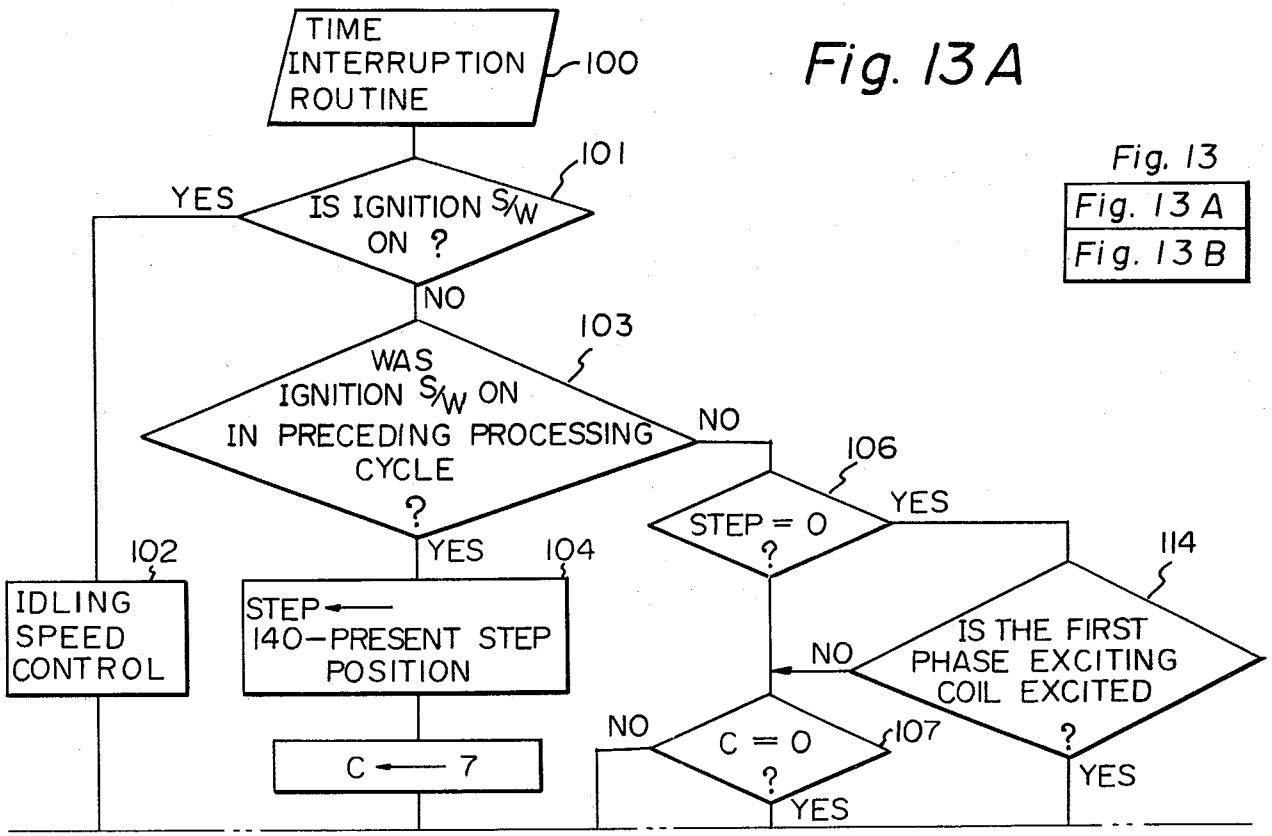
FIGS. 13A and 13B are a flow chart illustrating the general flow of the operation of an embodiment according to the present invention.
Figure 13B:
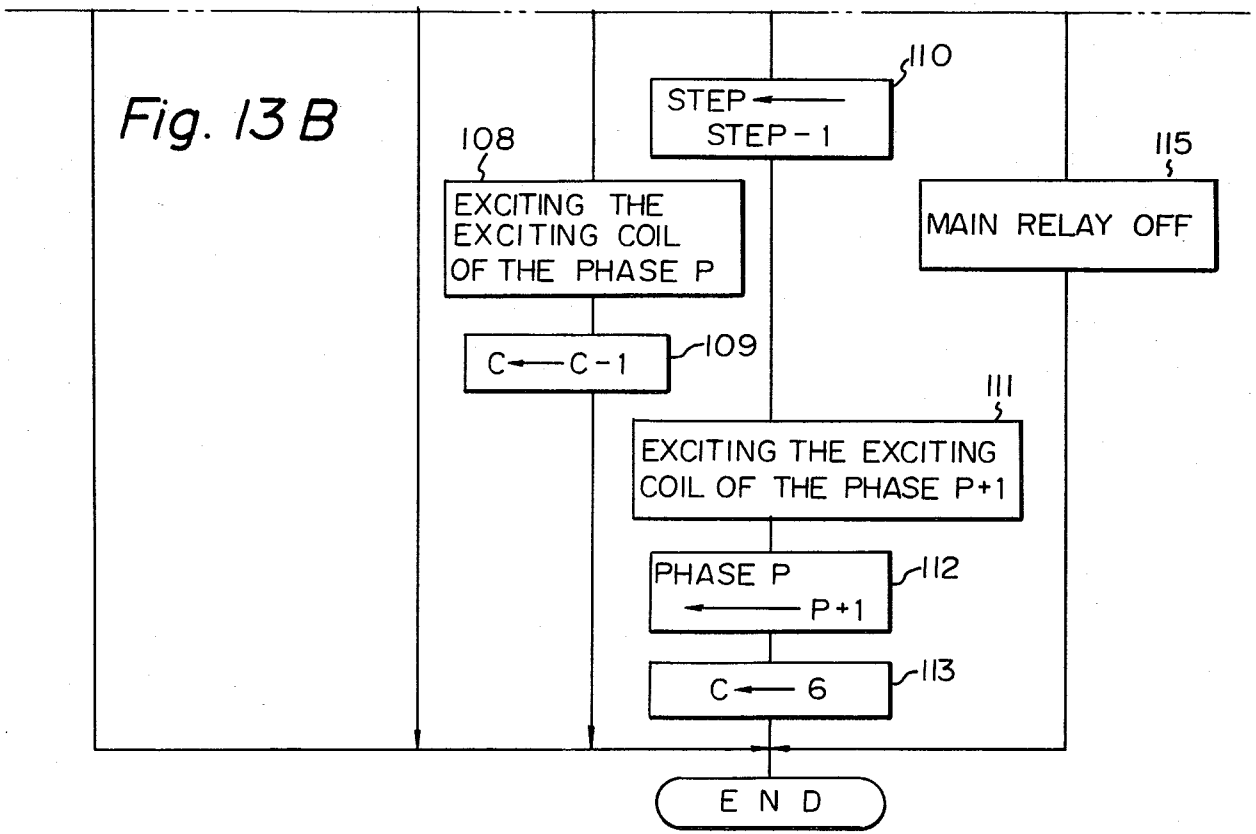

FIG. 13 illustrates a flow chart for controlling the rotating operation of the step motor 9. In FIG. 13, step 100 means that the routine is processed by sequential interruptions which are executed periodically at predetermined times. This interruption is executed, for example, every 8 msec. Firstly, in step 101, it is determined whether the ignition switch 92 is in the ON position and, if the ignition switch 92 is in the ON position, the routine goes to step 102. In step 102, the rotating motion of the step motor 9 is so controlled that the idling speed of the engine becomes equal to a predetermined desired idling speed and, then, the processing cycle is completed. On the other hand, if it is determined in step 101 that the ignition switch 92 is in the ON position, the routine goes to step 103, and it is determined whether the ignition switch 92 was in the ON position in the preceding processing cycle. If it is determined in step 103 that the ignition switch 92 was in the ON position in the preceding processing cycle, that is, if the ignition switch 92 is turned to the OFF position from the ON position, the routine goes to step 104. In step 104, the present step position of the step motor 9, which is stored in the RAM 81, is subtracted from the step number 140, and the result of the subtraction is put into STEP. Then, in step 105, the counter C is set by 7 and, then, the processing cycle is completed. In the next processing cycle, since it is determined in step 103 that the ignition switch 92 was not in the ON position in the preceding processing cycle, the routine goes to step 106, and it is determined whether the step number STEP is equal to zero. When the routine initially goes to step 106, since the step number STEP is not equal to zero, the routine goes to step 107. In step 107, it is determined whether the content of the counter C is equal to zero. At this time, since the counter C has been set by 7 in step 105, it is determined in step 107 that the content of the counter C is not equal to zero and, thus, the routine goes to step 108. In step 108, a single exciting coil of a phase P, corresponding to the present step position of the step motor 9, is excited. That is, when a single exciting coil is excited, the exciting coil of the phase P is the coil which is excited. Then two exciting coils are excited, the exciting coil of the phase P is one of the exciting coils which is excited. When the step motor 9 remains stopped, the exciting coil of the phase P in the single exciting coil which was excited immediately before the step motor 9 is stopped. A mentioned above, in step 108, the single exciting coil of the phase P, for example, the first phase exciting coil I is excited and, then, in step 109, the content of the counter C is decremented by one. After this, the processing cycle is completed.

The first phase exciting coil I is continuously excited until it is determined in step 107 that the content of the counter C is equal to zero. Therefore, since the interruption is executed every 8 msec as mentioned above, the first phase exciting coil I is continuously excited for $8\times7=56$ msec. When 56 msec has elapsed after the exciting operation of the first phase exciting coil I is started, since it is determined in step 107 that the content of the counter C is equal to zero, the routine goes to step 110, and the step number STEP is decremented by one. Then, in step 111, the exciting coil of the next phase $P+1$, that is, the second phase exciting coil II is excited. At this time, the first phase exciting coil I is still excited. Then, in step 112, the phase $P+1$ is put into the phase P. After this, in step 113, the counter C is set by 6 and, then, the processing cycle is completed.

Figure 14:
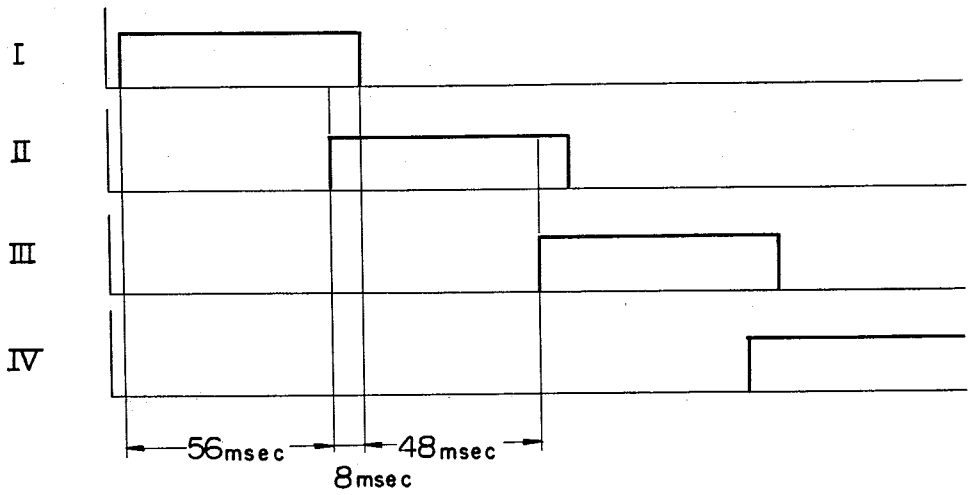
FIG. 14 is a time chart of control pulses of a step motor.

In the next processing cycle, since it is determined in step 107 that the content of the counter C is not equal to zero, the routine goes to step 108, and the second phase exciting coil II is excited. This second phase exciting coil II is continuously excited until it is determined in step 107 that the content of the counter C is equal to zero, that is, for $8\times6=48$ msec. Consequently, as illustrated in FIG. 14, the first phase exciting coil I, the second phase exciting coil II, the third phase exciting coil III and the fourth phase exciting coil IV are successively excited for 64 msec. The step number STEP, calculated in step 104 of FIG. 13 indicates a step number by which the step motor 9 moves. Since the entire step number of the step motor 9 is equal to 125 as mentioned previously, it will be understood that the step motor 9 is rotated by $140-125=15$ step after the valve head 36 (FIG. 2) is fully opened. That is, the drive force, which causes the step motor 9 to rotate by 15 steps in a rotating direction wherein the valve head 36 is fully opened, acts on the step motor 9 after the hollow cylindrical inner body 40 comes into engagement with the second stop pin 27. When it is determined in step 106 that the step number STEP is equal to zero, the routine goes to step 114, and it is determined whether the first phase exciting coil I is excited. If the first phase exciting coil I is not excited, the routine goes to step 107. On the other hand, if it is determined in step 114 that the first phase exciting coil I is excited, the routine goes to step 115. In step 115, the coil 96 of the main relay 93 is deenergized and, thus, the switch 94 is turned to the OFF position. As a result of this, the power supply to the electronic control unit 61 is stopped.

According to the present invention, it is possible to precisely control the amount of air flowing within the bypass pipe by using a step motor. In addition, by adopting the two-phase exciting system, it is possible to increase the driving power of the step motor. Furthermore, since the exciting coils are not excited when the step motor remains stopped, the consumption of the electric power is small and, in addition, it is possible to prevent the electronic control unit from overheating. In addition, when the ignition switch is turned to the OFF position, the step motor is slowly rotated in a rotating direction wherein the valve head is fully opened by increasing the duration of production of the control pulse signal. As a result of this, since the hollow cylindrical inner body of the rotor is retained in a stable state a little while after the hollow cylindrical inner body comes into engagement with the second stop pin, and since the reaction force, produced when the hollow cylindrical inner body comes into engagement with the second stop pin, is reduced, it is possible to assuredly stop the step motor at a position wherein the valve head is fully opened.

While the invention has been described by reference to a specific embodiment chosen for purposes of illustration, it should be apparent that numerous modifications could be made thereto by those skilled in the art without departing from the basic concept and scope of the invention.

We claim:

1. A device of controlling the idling speed of an engine comprising a main intake passage, a throttle valve arranged in the main intake passage, a bypass passage branched off from the main intake passage upstream of the throttle valve and connected to the main intake passage downstream of the throttle valve, and a control valve arranged in the bypass passage, said device comprising:

a step motor actuating the control valve for controlling the amount of air flowing within the bypass passage;

first means for detecting the engine speed to produce an output signal indicating the engine speed, second means for detecting the operating condition of the engine to produce an output signal indicating that the engine is operating in an idling state, electronic control means operated in response to the output signal of said first means and the output signal of said second means and producing continuous control pulse signals at predetermined first time intervals for rotating the step motor in a stepping manner at a first speed in a direction wherein the engine speed approaches a desired engine speed when the engine is operating in an idling state, and;

power supply control means including an ignition switch and inserted between said electronic control means and a power source, said electronic control means producing continuous control pulse signals at predetermined second time intervals which are longer than said first time intervals for rotating the step motor in a predetermined direction at a second speed which is lower than said first speed when the ignition switch is turned to the OFF position.

2. A device according to claim 1, wherein the step motor is rotated in a rotating direction wherein the control valve fully opens the bypass passage after the ignition switch is turned to the OFF position.

3. A device according to claim 2, wherein said electronic control means continuously produces continuous control pulse signals at the second time interval a little while after the control valve fully opens the bypass passage.

4. A device according to claim 3, wherein said step motor is a multiphase step motor, and the rotating motion of the step motor is stopped at a predetermined phase after the control valve fully opens the bypass passage.

5. A device according to claim 1, wherein said power supply control means comprises a relay arranged in parallel to the ignition switch for controlling the supply of electric power fed into said electronic control means.

6. A device according to claim 5, wherein said relay shuts off the supply of power in response to an output power of said electronic control means after the ignition switch is turned to the OFF position.

7. A device according to claim 1, wherein said step motor is a four phase step motor, and two phases are excited for rotating the step motor when the engine is operating in an idling state.

8. A device according to claim 7, wherein a single phase and two phases are alternately excited for rotating the step motor after the ignition switch is turned to the OFF position.

9. A device according to claim 8, wherein the time period, during which the single phase is excited, is longer than the time period during which the two phases are excited.

10. A device according to claim 1, wherein said second means comprises a throttle switch, a vehicle speed sensor and a neutral switch.

* * * * *